United States Patent [19]

Shiel

[11] 4,174,998

[45] Nov. 20, 1979

[54] PREFLOCCULATED FILLER COMPOSITIONS FOR USE IN THE MANUFACTURE OF PAPER

[75] Inventor: Leslie E. Shiel, Gravesend, England

[73] Assignee: The Associated Portland Cement Manufacturers Limited, London, England

[21] Appl. No.: 768,779

[22] Filed: Feb. 15, 1977

Related U.S. Application Data

[63] Continuation of Ser. No. 628,791, Nov. 4, 1975, abandoned.

[30] Foreign Application Priority Data

Nov. 15, 1974 [GB] United Kingdom ..... 49657/74

[51] Int. Cl.[2] ..... D21D 3/00

[52] U.S. Cl. ..... 162/168 N; 106/306; 106/308 C; 106/308 N; 162/168 NA; 162/175; 162/181 R; 162/181 A; 162/181 D; 162/183; 252/310

[58] Field of Search ..... 162/168 R, 168 NA, 181 A, 162/175, 181 R, 183, 181 D; 106/306, 308 C, 308 N; 210/54 A, 54 C, 54 R; 252/310

[56] References Cited

U.S. PATENT DOCUMENTS

| | | | |
|---|---|---|---|
| 2,949,397 | 8/1960 | Werner et al. | 162/178 |
| 2,972,560 | 2/1961 | Stilbert et al. | 162/168 NA |
| 3,021,257 | 2/1962 | Stauffenberg | 162/168 R |
| 3,052,595 | 9/1962 | Pye | 162/164 R |
| 3,132,066 | 5/1964 | Kerr et al. | 162/175 |
| 3,492,225 | 1/1970 | Ryznar | 210/54 A |
| 3,597,251 | 8/1971 | Kaufman | 162/181 A |
| 3,873,336 | 3/1975 | Lambert et al. | 162/175 |

FOREIGN PATENT DOCUMENTS 1353015 5/1974 United Kingdom .

*Primary Examiner*—S. Leon Bashore
*Assistant Examiner*—Peter Chin
*Attorney, Agent, or Firm*—Diller, Ramik & Wight

[57] ABSTRACT

A preflocculated filler composition for use in paper comprising a pigment, a starch phosphate and an organic polymeric retention aid such as a polyacrylamide, the combined weight of starch phosphate and organic polymeric retention aid on a solids basis being from 0.1 to 20 percent of the weight of the pigment.

15 Claims, No Drawings

PREFLOCCULATED FILLER COMPOSITIONS FOR USE IN THE MANUFACTURE OF PAPER

This is a continuation, of application Ser. No. 628,791 filed Nov. 4, 1975 abandoned.

This invention relates to compositions, for use as fillers in the manufacture of paper, containing a pigment component such as clay, lithopone, barium sulphate, titanium pigments, talc and satin white, and calcium carbonate, for instance chalk whiting.

Such mineral fillers are included in the furnish for the manufacture of various types of paper. As the proportion of filler to cellulose increases, the opacity of the eventual paper increases but the strength properties tend to decrease and moreover the fillers tend to be lost into the water drained from the wet formed paper web, so that it is usual to add so-called retention aids. These are normally polymers of high molecular weight which tend to flocculate together the filler particles and the cellulose fibres.

It is an object of the present invention to provide a filler composition with an enhanced ability to flocculate on the fibre, which enables higher filler or pigment loadings to be achieved in paper without detriment to strength, optical and other properties.

The invention is applicable not only in connection with conventional sizing sytems using alum, but also finds application in alkaline and neutral sizing systems.

In the case of chalk whitings there has been much interest in the possibility of their use as fillers in the manufacture of paper by reason of their low cost and ready availability. However, a factor that has inhibited the acceptability of such whiting fillers in acid systems has been their susceptibility to acid attack, usually as a result of the use of papermakers' alum, resulting in a loss of sizing and various other undesirable side effects.

For this reason various methods have been proposed for protecting whitings utilised for this purpose by treating them with organic materials which are to some extent effective in preventing acid attack upon the whiting during a papermaking process. Various organic materials have been proposed for this purpose, including starches, alginates and water soluble polyacrylates. In our U.K. Patent Specification No. 11555/73 we describe the synergistic effect of mixtures of starches and water-soluble alginates and polyacrylates on the degree of protection afforded to chalk whiting for use in paper systems.

It is a further object of the present invention to provide a filler composition containing a pigment protected from acid attack, which is cheaper in terms of labour and capital equipment involved in its use than those employed hitherto.

It is another object of the invention to provide a novel and improved filler composition of pigment and retention aid therefor.

We have now found surprisingly that starch phosphates can confer improved acid resistance to pigments such as chalk whitings otherwise susceptible to acid attack and that certain compositions containing starch phosphates and pigments have improved solubility and flocculation properties favourable to papermaking.

Some starch phosphates have hitherto been used in the paper industry mainly in paper coating applications to produce water insoluble coatings but also to a small extent as wet end additives to improve strength, wax pick and filler retention (Paper Trade J. 145, No. 28, 48, 51 (1961)). They have also been applied to papermaking instead of starch and in conjunction with pigment already compatible with acidic systems, for example titanium dioxide, (U.S. Pat. No. 3,132,066).

According to the present invention we provide a filler composition for use in paper which comprises a pigment, a starch phosphate and an organic polymeric retention aid, the combined weight of starch phosphate and organic polymeric retention aid on a solids basis being from 0.1 to 20 percent of the weight of the pigment.

The composition is used as such in papermaking, that is to say the ingredients of the composition are brought together as a mixture, and preferably as a dispersion in water, before being introduced into the medium containing paper fibres.

Starch phosphates are described for instance in "Starch: Chemistry and Technology", Volume 3, Academic Press, 1967, Ch.XIV, and in general are starch esters of acids of phosphorus and include metal salts of the esters, such as the disodium or dipotassium salts of the starch monoesters of phosphoric acid, derived from the use of water-soluble metal phosphates in the manufacture of the starch esters.

The starch phosphates contemplated in relation to the present invention are mainly monoesters and diesters of the acid and are principally water-soluble, the acids of phosphorus from which they are derived being generally but not exclusively orthophosphoric, pyrophosphoric and tripolyphosphoric acids. Any starch in raw or modified or derivative form, in gelatinised or granular state, may be used to make the starch phosphate, for example in addition to raw starches, thin boiling starches, dextrins, and derivatives of starches may be used, such as ethers and esters other than the phosphates, as long as they have at least one free hydroxyl group. The type of starch is not restricted, cereal starches such as corn starch being exemplary.

Particularly preferred starch phosphates have a degree of substitution (DS) of from 0.002 to 1.0 of bound phosphorus, the higher DS values being most preferable from the point of view of solubility in water and degree of protection conferred on acid sensitive filler material or pigment. DS is defined as the weight percent of phosphorus in a sample divided by the weight percent of phosphorus (12.8) in a starch phosphate having a DS of 1.0. The starch phosphates can be used singly or in combination with starches, for example anionic, cationic or beater starches, or with other polymers.

The organic polymeric retention aid is of the class well-known as such, and those particularly preferred are of the polyacrylamide or polyamide types. The retention aids used have the effect of rendering the filler composition flocculent. We have found that there is a degree of interaction between the starch phosphate and the retention aid in respect of their substantiveness to papermaking fibres.

The pigment component of the filler composition is incorporated therein in the state, e.g., as to particle size, and in a manner, normal in the known art associated with papermaking. The three essential constituents of the composition, whether or not already dissolved or dispersed in water, are brought together in that form and applied to the papermaking furnish as a filler in the amount to give the desired filler loading in the paper.

The proportion of total starch phosphate plus organic polymeric retention aid, on a solids basis, is from 0.1 to 20 percent, preferably 2 to 10 percent by weight based on the pigment component. The organic polymeric retention aid preferably represents from 0.1 to 25 percent on a solids basis, of the combined weight of starch phosphate and the retention aid.

The acid resistance of pigments in this context may be determined by the following method. 480 Grams of distilled water is placed in a 600 ml beaker and 22.5 ml of 5 percent alum solution is added from a burette. A pH electrode is placed in the solution and the latter is continuously stirred. 10 Grams of a 35 percent solids slurry of the pigment under test are weighed into a shallow container. The initial pH of the alum/water solution is noted as $pH_o$ and the slurry is then poured into the beaker and the container rinsed with 10 ml distilled water. The pH value, $pH_t$, is recorded at intervals of 15 seconds and $pH_t/pH_o$ is plotted against time; the lower the rate of increase in pH, the higher the acid resistance of the sample.

The acid resistance of whitings treated by the addition thereto of starch phosphate and retention aid polymer according to the invention was determined by the foregoing method and the results showed that the rate of pH increase of the thus protected whiting was similar to, if not better than, that with whitings treated with prior protectants such as mixtures of starches with alginates or polyacrylates.

The following Examples are given for the purpose of illustrating the invention. The starch phosphate used was a cold water soluble potato starch phosphate ester and the retention aid polymer was an anionic polyacrylamide.

EXAMPLE 1

Comparison of acid resistance

The following three filler compositions were tested for acid resistance according to the foregoing method:

A. Chalk whiting paper filler;

B. Chalk whiting paper filler protected by a starch/alginate combination;

C. Chalk whiting treated with 4.4 percent by weight based on the whiting, of a combination of the starch phosphate and retention aid polymer according to the invention (4 percent starch phosphate, 0.4 percent polymer).

The pH increase obtained, $pH_t/pH_o$, is indicated in the following Table 1.

TABLE 1

| Time, secs | pH increase rate, $pH_t/pH_o$ A | B | C |
|---|---|---|---|
| 0 | 1.0 | 1.0 | 1.0 |
| 15 | 1.12 | 1.07 | 1.01 |
| 30 | 1.225 | 1.09 | 1.05 |
| 45 | 1.355 | 1.115 | 1.09 |
| 60 | 1.41 | 1.155 | 1.15 |
| 75 | 1.425 | 1.18 | 1.19 |
| 90 | 1.435 | 1.205 | 1.235 |
| 120 | 1.47 | 1.28 | 1.275 |
| 150 | 1.48 | 1.335 | 1.29 |
| 180 | 1.51 | 1.37 | 1.32 |
| 240 | 1.54 | 1.4 | 1.34 |

EXAMPLE 2

A filler composition was prepared by adding to an aqueous dispersion of chalk whiting a solution in water of 4 percent by weight of the starch phosphate and 0.4 percent by weight of the anionic polyacrylamide, based on the weight of the whiting. This composition was employed in amounts shown in Table 2 in a paper furnish having a 2 percent consistency and containing 50 per bleached softwood and 50 percent bleached hardwood, beaten to a Schopper-Riegler degree of 25 and sized with rosin and alum. Tests were carried out on the web formed, yielding the results shown in Table 2. Burst Strength was measured on a Schopper-Dalen tester, Breaking Length on a Lorentzen & Wettres machine and Tear Factor on an Elmendorg paper tear tester, all being expressed as a ratio per weight of paper substance.

Results of similar tests carried out on a paper furnish supplied with chalk whiting as the filler are also shown in Table 2.

TABLE 2

| Filler | Percent $CaCO_3$ addition | Percent $CaCO_3$ retained | Percent Retention | Burst Ratio | Breaking Length | Tear Factor |
|---|---|---|---|---|---|---|
| Example 2 | 28.33 | 14.39 | 50.79 | 4.39 | 6995 | 816 |
| Chalk Whiting alone | 33.33 | 14.22 | 42.66 | 3.49 | 5945 | 802 |
| Example 2 | 40.72 | 18.59 | 45.65 | 6846 | 771 | |
| Chalk Whiting alone | 50.00 | 19.40 | 38.80 | 3.30 | 5552 | 749 |

The percent whiting is based on the weight of the furnish.

EXAMPLE 3

Tests were conducted as in Example 2 on a web formed from a similar furnish but in which the filler according to the invention was clay with the starch phosphate and anionic polyacrylamide, and on a web in which untreated clay was used for comparison. The results are shown in Table 3.

TABLE 3

| Filler | Percent Clay addition | Percent Clay retained | Percent Retention | Burst Ratio | Breaking Length | Tear Factor |
|---|---|---|---|---|---|---|
| Example 3 | 29.18 | 13.9 | 47.63 | 3.98 | 5900 | 825 |
| Clay | 37.50 | 13.7 | 36.53 | 3.56 | 5880 | 808 |
| Example 3 | 39.83 | 17.7 | 44.44 | 3.86 | 5768 | 760 |
| Clay | 50.00 | 18.1 | 36.20 | 2.98 | 5014 | 741 |

What is claimed is:

1. A flocculated, aqueous filler composition for use in paper furnish, which comprises water, a pigment, a water soluble starch phosphate selected from the group consisting of starch monoesters of a phosphoric acid, starch diesters of a phosphoric acid and salts thereof, said starch phosphate having a DS of at least 0.002 in terms of bound phosphorous, and an organic polymeric papermaking retention material having the effect of rendering the filler composition flocculent in the aqueous composition, said organic polymeric material being selected from the group consisting of polyacrylamide and polyamide retention aids, said starch phosphate plus said organic polymeric material being present in amount of 0.1–20% by weight of said pigment and said organic polymeric material being present in amount of 0.1–25% of based upon the combined weights of said starch phosphate plus said organic polymeric material, said starch phosphate and said organic polymeric material interacting to increase their substantiveness to papermaking fibers thereby to increase the retention of said pigment.

2. A flocculated, aqueous filler composition according to claim 1, wherein the pigment is a chalk whiting.

3. A flocculated, aqueous filler composition according to claim 1, wherein the starch phosphate is a monoester or diester of a phosphoric acid or a water-soluble salt thereof.

4. A flocculated, aqueous filler composition as defined in claim 2 wherein said pigment is clay.

5. A flocculated, aqueous filler composition as defined in claim 1 wherein the starch phosphate is a cold water soluble potato starch phosphate ester in amount of 4% by weight based on the pigment and the polymeric material is anionic polyacrylamide in amount of 0.4% by weight based on the pigment.

6. A flocculated, aqueous filler composition as defined in claim 5 wherein said pigment is chalk whiting.

7. In a paper furnish which comprises cellulosic fibers in an aqueous medium sized with rosin and alum, the improvement which comprises:

a preflocculated filler composition comprising a pigment which is susceptible to acid attach due to the presence of said alum, a starch phosphate having a DS of from 0.002 to 1.0 of bound phosphorous sufficient to render the starch phosphate water soluble, said starch phosphate being present in amount sufficient to confer protection from acid attack to said pigment, and an organic polymeric material selected from the group consisting of polyacrylamide and polyamide retention aids, said organic polymeric material being effective to render the filler composition flocculent and being present in amount sufficient to interact with the starch phosphate to increase their substantiveness to said cellulosic fibers to increase the retention of said pigment in paper made from said furnish, said starch phosphate plus said organic polymeric material being present in amount of 0.1–20% by weight of said pigment, and said organic polymeric material being present in amount of 0.1–25% based upon the combined weight of said starch phosphate plus said organic polymeric material.

8. In a paper furnish as defined in claim 7 wherein said organic polymeric material is an anionic polyacrylamide retention aid.

9. In a paper furnish as defined in claim 8 wherein said pigment is chalk whiting, said starch phosphate is present in amount of 4% by weight of said pigment and said polyacrylamide is present in amount of 0.4% by weight of said pigment.

10. In a paper furnish as defined in claim 7 wherein said starch phosphate is a cold water soluble potato starch phosphate ester present in amount of 4% by weight of said pigment and said polymeric material is an anionic polyacrylamide retention aid present in amount of 0.4% by weight of pigment.

11. In a paper furnish as defined in claim 10 wherein said pigment is chalk whiting.

12. In a paper furnish as defined in claim 10 wherein said pigment is clay.

13. In a paper furnish which comprises sized cellulosic fibers in an aqueous medium, the improvement which comprises:

a preflocculated filler composition comprising a pigment, a starch phosphate having a DS of from 0.002 to 1.0, and an organic polymeric material selected from the group consisting of polyacrylamide and polyamide retention aids, said organic polymeric material being effective to render the filler composition flocculent and being present in amount sufficient to interact with the starch phosphate to increase their substantiveness to said cellulosic fibers to increase the retention of said pigment in paper made from said furnish, said starch phosphate plus said organic polymeric material being present in amount of 0.1–20% by weight of said pigment, and said organic polymeric material being present in amount of 0.1–25% based upon the combined weight of said starch phosphate plus said organic polymeric material.

14. The method of incorporating chalk whiting as filler in the manufacture of paper, which comprises the steps of:

(a) forming a preflocculated filler in an aqueous medium by dispersing chalk whiting in water in the presence of about 4% by weight based on the chalk whiting of a water soluble starch phosphate having a DS of from 0.002–1.0% of bound phosphorous and about 0.4% by weight based on the chalk whiting of an anionic polyacrylamide retention aid; and then (b) adding said preflocculated filler to a paper furnish having a 2 percent consistency and containing 50% bleached softwood and 50% bleached hardwood beaten to a Schopper-Riegler degree of 25 and sized with rosin and alum.

15. The method according to claim 14 wherein said starch phosphate is a cold water soluble potato starch phosphate ester.

* * * * *